US009348313B2

(12) United States Patent
Klinger et al.

(10) Patent No.: US 9,348,313 B2
(45) Date of Patent: May 24, 2016

(54) ANTI-ADHESION DEVICE FOR A BALANCE SPRING ON A BAR

(71) Applicant: ETA SA Manufacture Horlogere Suisse, Grenchen (CH)

(72) Inventors: Laurent Klinger, Bienne (CH); Thierry Conus, Lengnua (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 14/257,146

(22) Filed: Apr. 21, 2014

(65) Prior Publication Data

US 2014/0341000 A1 Nov. 20, 2014

(30) Foreign Application Priority Data

May 17, 2013 (EP) ..... 13168277

(51) Int. Cl.
*G04B 15/14* (2006.01)
*G04B 17/06* (2006.01)
*G04B 29/02* (2006.01)

(52) U.S. Cl.
CPC ..... *G04B 15/14* (2013.01); *G04B 17/066* (2013.01); *G04B 29/025* (2013.01)

(58) Field of Classification Search
CPC ..... G04B 17/06; G04B 29/02; G04B 15/14; G04B 17/063; G04B 17/066; G04B 17/32; G04B 29/025
See application file for complete search history.

(56) References Cited

U.S. PATENT DOCUMENTS

| | | | | |
|---|---|---|---|---|
| 2006/0055097 | A1* | 3/2006 | Conus et al. | 267/273 |
| 2008/0037376 | A1* | 2/2008 | Lippuner et al. | 368/139 |
| 2009/0016173 | A1* | 1/2009 | Hessler et al. | 368/140 |
| 2012/0008468 | A1 | 1/2012 | Bossart et al. | |
| 2012/0075963 | A1* | 3/2012 | Zaugg | 368/127 |

FOREIGN PATENT DOCUMENTS

| | | | |
|---|---|---|---|
| EP | 1 837 721 | A1 | 9/2007 |
| EP | 2 407 831 | A1 | 1/2012 |
| IT | 296182 | | 10/1936 |
| WO | 2012/152843 | A1 | 11/2012 |

OTHER PUBLICATIONS

English Translation of Corthesy, WO 2012/152843, electronically translationed Jan. 22, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

The invention relates to a timepiece movement including a resonator formed by the cooperation of a balance with a balance spring, said resonator being pivotally mounted between a bar and another part such as a bar or a main plate. According to the invention, the timepiece movement further includes a device preventing adhesion of said balance spring against said bar including a surface decreasing means formed on the bar for limiting the contact surface when the faces of said balance spring and of said bar touch each other.

9 Claims, 2 Drawing Sheets

(56) References Cited

OTHER PUBLICATIONS

English Translation of Junghans, IT 296,182, electronically translationed May 19, 2015.*

European Search Report issued Nov. 27, 2013, in Patent Application No. EP 13 16 8277, filed May 17, 2013 (with English-language translation).

* cited by examiner

ANTI-ADHESION DEVICE FOR A BALANCE SPRING ON A BAR

This application claims priority from European patent application No. 13168277.5 filed May 17, 2013, the entire disclosure of which is hereby incorporated by reference.

FIELD OF THE INVENTION

The invention relates to a device for preventing adhesion of a balance spring on a bar and more specifically to a balance spring forming part of a sprung balance resonator.

BACKGROUND OF THE INVENTION

Insulating materials, such as silicon and silicon compounds, quartz, diamond, glass, ceramic or other materials are increasingly used for making micromechanical timepiece parts. As seen in FIGS. 2 and 3, it has been observed, in particular with a balance spring 7, that after a shock, coils tend to adhere to bar 2 which is detrimental to the isochronism of the oscillator.

This phenomenon may be aggravated by the contamination of bar 2 and/or balance spring 7 with impurities or lubricant during manufacture or wear, particularly in the event of shocks. It is thus clear that some of the coils of balance spring 7 may adhere to the bar because of impurities or lubricant even though the balance spring is electrically conductive.

SUMMARY OF THE INVENTION

It is an object of the present invention to overcome all or part of the aforementioned drawbacks, by providing a device for preventing adhesion of a balance spring on a bar.

The invention therefore relates to a timepiece movement including a resonator formed by the cooperation of a balance with a balance spring, said resonator being pivotally mounted between a bar and another part, characterized in that the timepiece movement further includes a device for preventing adhesion of said balance spring against said bar including a surface decreasing means formed on the bar for limiting the contact surface when the faces of said balance spring and of said bar touch each other.

As a result of their manufacturing process, balance springs obtained by etching a silicon or quartz wafer have particularly smooth surfaces prone to adhesion. It is therefore understood that, advantageously according to the invention, as a result of the anti-adhesion device, the faces of the balance spring and of the bar which face each other offer a much more limited potential surface of adhesion which limits these problems.

In accordance with other advantageous features of the invention:

- a surface decreasing means is also formed on the balance spring;
- the surface decreasing means includes at least one recess in relation to the faces of said balance spring and of said bar which face each other;
- said at least one recess forms series of grooves;
- at least two of said series of grooves are secant;
- the surface decreasing means includes at least one protruding portion in relation to the faces of said balance spring and of said bar which face each other;
- said at least one protruding portion forms series of ribs;
- at least two of said series of ribs are secants.

Moreover, the invention relates to a timepiece, characterized in that it includes a timepiece movement according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
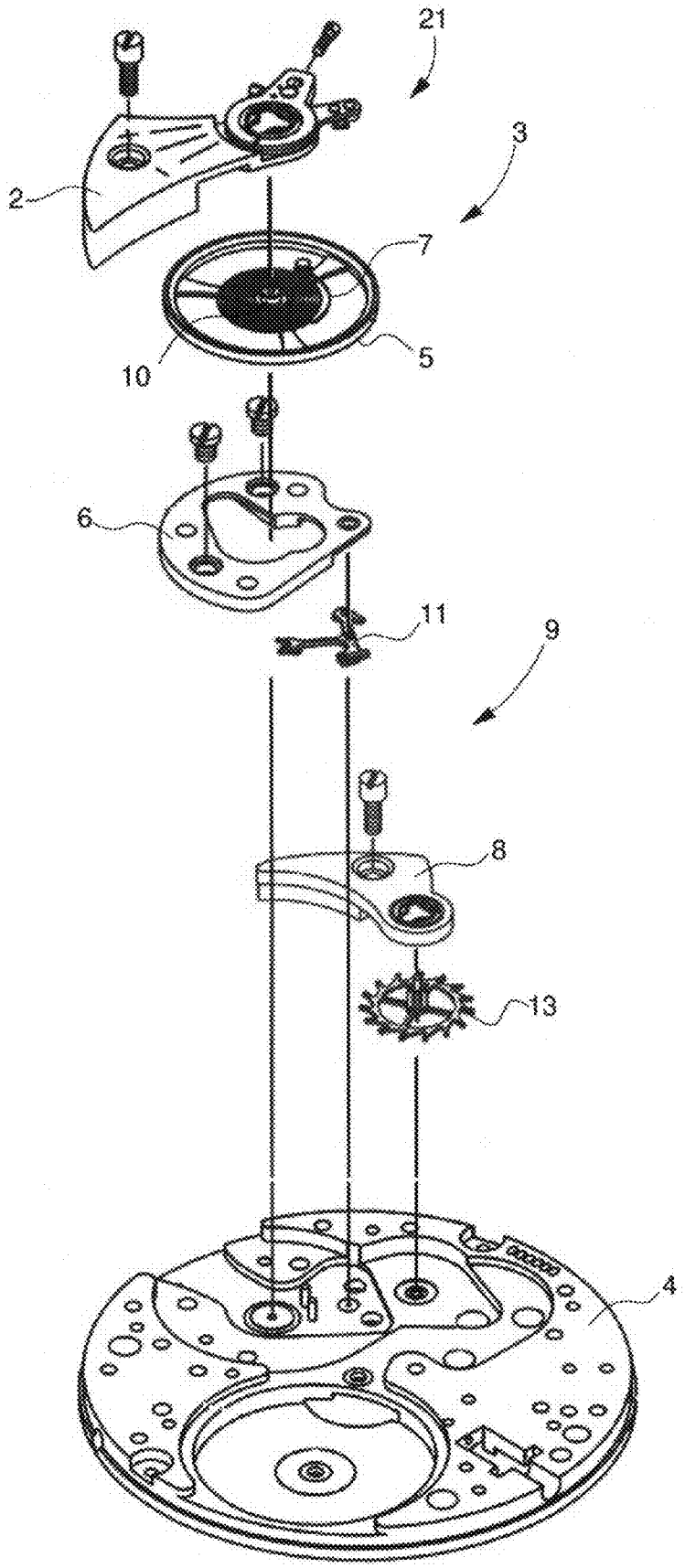
FIG. 1 is an exploded view of timepiece movement according to the invention.
Figure 2:
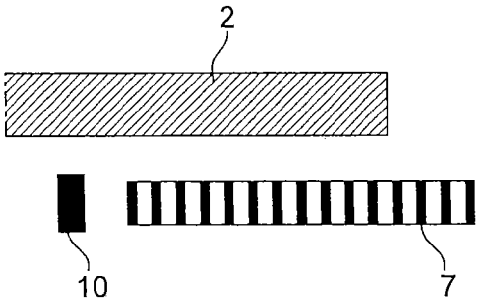
Fig. 2 Prior Art
FIGS. 2 and 3 are views of a balance spring, formed of insulating material moving opposite a bar, respectively at rest and in motion.
Figure 3:
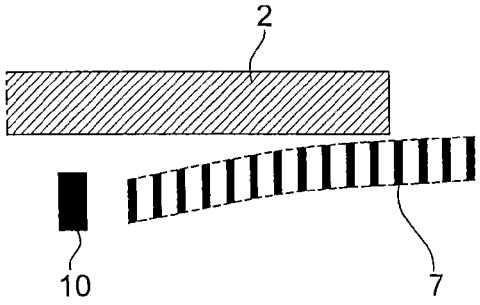
Fig. 3 Prior Art

FIG. 1 shows a partial view of a timepiece movement 1 according to the invention, intended to be mounted in a timepiece. Movement 1 preferably includes a resonator 3 comprising a balance 5 and a balance spring 7 for regulating movement 1. Resonator 3 is preferably pivotally mounted between a bar 2 and another part 4, such as a bar or a main plate. To achieve this, balance spring 7 includes, in particular, a collet 10 which may or may not be integral therewith.

FIG. 1 also shows that movement 1 preferably includes an escapement system 9 comprising a Swiss pallet lever 11 and an escape wheel 13 intended to distribute the motions of the resonator and also to maintain them. Escapement system 9 is preferably mounted between two bars 6, 8 and main plate 4.

Advantageously according to the invention, balance spring 7 and possibly its collet 10, may be formed from any material and particularly from silicon and silicon compounds, quartz, diamond, glass, ceramic, a metal or a metal alloy. Bar 2 may also be formed from any material and particularly from a metal or a metal alloy.

Further, movement 1, preferably according to the invention, also includes a device 19, 19', 19" for preventing adhesion of balance spring 7, 7', 7" against bar 2, 2', 2" including surface decreasing means 23, 23', 25, 25' between the faces of balance spring 7, 7', 7" and of bar 2, 2', 2" which face each other to prevent variations in rate of movement 1.

Figure 4:
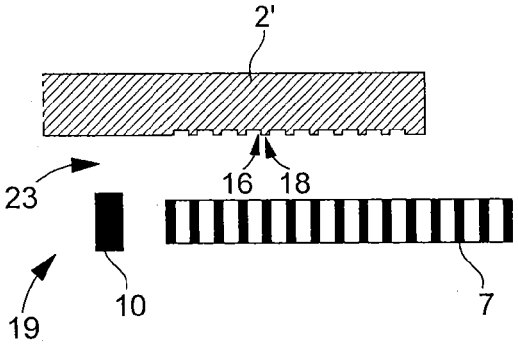
FIG. 4 is schematic view of an exemplary embodiment of an anti-adhesion device and a vertical cross-section of a coil according to one example.
Figure 5:
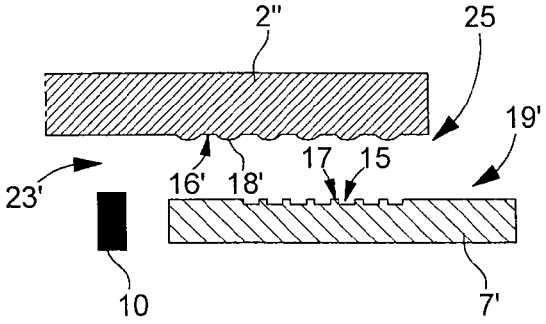
FIG. 5 is a schematic view of an exemplary embodiment of an anti-adhesion device and a cross-sectional view of a coil according to one example.
Figure 6:
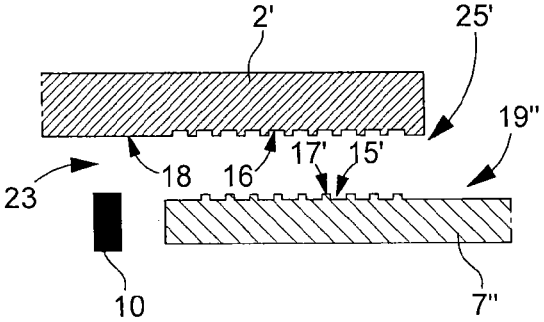
FIG. 6 is a schematic view of an exemplary embodiment of an anti-adhesion device and a cross-sectional view of a coil according to one example.

As explained by FIGS. 4 to 6, advantageously according to the invention, surface decreasing means 23, 23', 25, 25' may be formed on balance spring 7, 7', 7" and/or on bar 2, 2', 2". By way of non-limiting example, three embodiments of anti-adhesion device 19, 19', 19" show, in FIGS. 4 to 6, four alternatives of surface decreasing means 23, 23', 25, 25' according to the invention.

According to a first embodiment illustrated in FIG. 4, the timepiece movement includes a first example of anti-adhesion device 19. Anti-adhesion device 19 includes a surface decreasing means 23 formed on bar 2'. Surface decreasing means 23 in the FIG. 4 example includes at least one recess 16 in relation to face 18 of bar 2'. According to the invention, each recess 16 may form one or more series of grooves. In the FIG. 4 example, a single balance spring-shaped groove is formed on face 18 of bar 2'. However, in the case where at least two series of grooves are formed, they may or may not be secant. By way of example, the grooves may therefore take the form of rays of the sun or indentations.

According to a second embodiment illustrated in FIG. 5, the timepiece movement includes a second anti-adhesion device example 19'. Anti-adhesion device 19' includes a first surface decreasing means 23' formed on bar 2" and a second surface decreasing means 25 formed on balance spring 7'.

Surface decreasing means 23' in the FIG. 5 example includes at least one protruding portion 18' in relation to face 16' of bar 2". According to the invention, each protruding portion 18' may form one or more series of ribs. In the FIG. 5 example, a single balance spring-shaped rib is formed on face 16' of bar 2". However, in the case where at least two series of ribs are formed, they may or may not be secant. By way of example, the ribs may thus take the form of rays of the sun or indentations.

Surface decreasing means 25 in the FIG. 5 example includes at least one recess 15 in relation to face 17 of balance spring 7'. According to the invention, each recess 15 may form one or more series of grooves. In the FIG. 5 example, multiple parallelepiped grooves are formed on face 17 of balance spring 7'. However, a single groove may run over all or part of the face of the balance spring or at least two series of grooves formed may be secant. By way of example, a single groove may be at a certain depth/height on only one part of the thickness in order to form a furrow on the face of balance spring 7' or series of grooves may form indentations.

According to a third embodiment illustrated in FIG. 6, the timepiece movement includes a third example anti-adhesion device 19". Anti-adhesion device 19" includes a first surface decreasing means 23 formed on bar 2' and a second surface decreasing means 25' formed on balance spring 7".

Surface decreasing means 23 in the FIG. 4 example includes at least one recess 16 in relation to face 18 of bar 2'. According to the invention, each recess 16 may form one or more series of grooves. In the FIG. 4 example, a single balance spring-shaped groove is formed on face 18 of bar 2'. However, in the case where at least two series of grooves are formed, they may or may not be secant. By way of example, the grooves may therefore take the form of rays of the sun or indentations.

Surface decreasing means 25' in the FIG. 6 example includes at least one protruding portion 17' in relation to face 15' of balance spring 7". According to the invention, each protruding portion 17' may form one or more series of ribs. In the FIG. 6 example, multiple parallelepiped grooves are formed on face 15' of balance spring 7". However, a single rib may run over all or part of the face of balance spring 7" or at least two series of ribs formed may be secants. By way of example, a single rib may be at a certain elevation in relation to the height over only one part of the thickness in order or form a double shoulder on the face of balance spring 7", or series of ribs may form indentations.

Of course, this invention is not limited to the illustrated example but is capable of various variants and alterations that will appear to those skilled in the art. In particular, it is clear that the anti-adhesion devices may take other, particularly geometric shapes. Further, the embodiments and/or alternatives may be combined with each other according to the movement configurations used. It is clear in particular that either the bar, or the balance spring, or both are modified in order to decrease their potential contact surface.

What is claimed is:

1. A timepiece movement including a resonator formed by the cooperation of a balance with a balance spring, the resonator being pivotally mounted between a bar and another part, wherein the bar includes a surface decreasing means formed on the bar for limiting the contact surface when the faces of the balance spring and of the bar touch each other, and wherein the surface decreasing means includes at least one recess in relation to the faces of the balance spring and of the bar which face each other.

2. The timepiece movement according to claim 1, wherein a surface decreasing means is also formed on the balance spring.

3. The timepiece movement according to claim 1, wherein the at least one recess forms a series of grooves.

4. The timepiece movement according to claim 3, wherein at least two of the series of grooves form intersecting curves.

5. A timepiece wherein the timepiece includes a timepiece movement according to claim 1.

6. A timepiece movement including a resonator formed by the cooperation of a balance with a balance spring, the resonator being pivotally mounted between a bar and another part, wherein the bar includes a surface decreasing means formed on the bar for limiting the contact surface when the faces of the balance spring and of the bar touch each other, and wherein the surface decreasing means includes at least one protruding portion in relation to the faces of the balance spring and of the bar which face each other.

7. The timepiece movement according to claim 6, wherein the at least one protruding portion forms a series of ribs.

8. The timepiece movement according to claim 7, wherein at least two of the series of ribs form intersecting curves.

9. A timepiece wherein the timepiece includes a timepiece movement according to claim 6.

* * * * *